US011603595B2

(12) United States Patent
Tesser et al.

(10) Patent No.: US 11,603,595 B2
(45) Date of Patent: Mar. 14, 2023

(54) ELECTROLYTIC TREATMENT DEVICE FOR PREPARING PLASTIC PARTS TO BE METALLIZED AND A METHOD FOR ETCHING PLASTIC PARTS

(71) Applicant: Coventya S.P.A., Carugo (IT)

(72) Inventors: Giorgio Tesser, Oderzo (IT); Sandrine Dalbin, Maserada Sul Piave (IT)

(73) Assignee: Coventya S.P.A., Carugo (IT)

( * ) Notice: Subject to any disclaimer, the term of this patent is extended or adjusted under 35 U.S.C. 154(b) by 0 days.

(21) Appl. No.: 17/776,406

(22) PCT Filed: Nov. 20, 2020

(86) PCT No.: PCT/EP2020/082864
§ 371 (c)(1),
(2) Date: May 12, 2022

(87) PCT Pub. No.: WO2021/099556
PCT Pub. Date: May 27, 2021

(65) Prior Publication Data

US 2022/0411953 A1 Dec. 29, 2022

(30) Foreign Application Priority Data

Nov. 21, 2019 (EP) ..... 19210726

(51) Int. Cl.
*C23F 1/46* (2006.01)
*C25F 7/02* (2006.01)
*C25F 3/02* (2006.01)

(52) U.S. Cl.
CPC ..... *C23F 1/46* (2013.01); *C25F 3/02* (2013.01); *C25F 7/02* (2013.01)

(58) Field of Classification Search
CPC ..... C23F 1/46; C25F 7/02; C25F 3/02; C25B 11/079; C25B 11/089
See application file for complete search history.

(56) References Cited

U.S. PATENT DOCUMENTS 4,243,501 A 1/1981 Wright, Jr.
2009/0092757 A1* 4/2009 Satou ..... C23C 18/31 252/79.2
2011/0089045 A1 4/2011 Cardarelli

FOREIGN PATENT DOCUMENTS

CN 110438506 A * 11/2019
EP 2971260 B1 1/2016
JP 5403535 B2 1/2014

OTHER PUBLICATIONS

Clancy et al. "The influence of alloying elements on the electrochemistry of lead anodes for electrowinning of metals: A review," Hydrometallurgy 131-132 (2013) 144-157 (Year: 2013).*
CN 110438506 A (translation) (Year: 2019).*

* cited by examiner

*Primary Examiner* — Nicholas A Smith
(74) *Attorney, Agent, or Firm* — Carmody Torrance Sandak & Hennessey LLP

(57) ABSTRACT

The present invention refers to an electrolytic treatment device having an anodic compartment comprising a non-chromium (VI) etching solution to be treated and immersed therein an anode. The anodic compartment is separated by a membrane from a cathodic compartment comprising a cathodic solution comprising an inorganic acid, wherein the anode and the cathode are used comprising or consisting of a ternary or higher Pb alloy with Sn and at least one further metal selected from the group consisting of Sb, Ag, Co, Bi and combinations thereof. Moreover, a method for etching plastic parts is provided as well.

15 Claims, 2 Drawing Sheets

A B C D

ELECTROLYTIC TREATMENT DEVICE FOR PREPARING PLASTIC PARTS TO BE METALLIZED AND A METHOD FOR ETCHING PLASTIC PARTS

The present invention refers to an electrolytic treatment device having an anodic compartment comprising a non-chromium (VI) etching solution to be treated and immersed therein an anode. The anodic compartment is separated by a membrane from a cathodic compartment comprising a cathodic solution comprising an inorganic acid, wherein the anode and the cathode are used consisting of a ternary or higher Pb alloy with Sn and at least one further metal selected from the group consisting of Sb, Ag, Co, Bi and combinations thereof. Moreover, a method for etching plastic parts is provided as well.

For metallization of plastic parts, a pre-treatment step is necessary to create sufficient roughness and anchoring points at the surface of the plastic part. This pre-treatment is called etching. Subsequently, the metallization by sensitization of the surface and electroless deposition can be conducted.

For many years, the etching solution was based on a mixture of chromic acid and sulfuric acid. Out of safety reasons it is now better to avoid the use of toxic compounds like hexavalent chrome and chromic acid. Due to the REACH regulation, chromic acid has to be avoided. Out of these reasons new etching solutions have been developed which are free of hexavalent chromium.

One of the most efficient chromium VI free etching solutions is a mixture of permanganate with inorganic acid. However, the main problem of permanganate is its limited long-term stability, in particular at high temperatures and at an acidic pH.

Hence, there is a need to add a co-oxidant like periodate to the etching solution in order to re-oxidize the lower valence manganese products. However, after a certain period, all the periodate is reduced to iodate. To counter this effect, an electrolytic treatment of the solution is necessary to recover the periodate concentration and re-oxidize the iodate to periodate. This can be performed internally in the etching bath or parallel in a separated re-oxidation module. The oxidation of iodate to periodate will take place at the anode which is immersed in the etching solution. The cathode is separated from the etching solution by a membrane to prevent reduction of the etching solution.

Lead alloy anodes/cathodes are currently the preferred choice for this application as they are conductive, economical and relatively stable in solutions having a high oxidant concentrations and a low pH. The main drawback of this type of anodes/cathodes is the formation of a precipitate on their surface which restricts the performance of the oxidation process and renders necessary the cleaning of the anode/cathode.

JP 5403535 describes a method of electrolytically treating an etching solution containing a manganese salt as an active ingredient. The method refers to treating an etching solution electrolytically by using an electrolytic treatment apparatus having a cathode chamber separated from an etching solution to be treated by a cation exchange membrane made of a perfluorosulfonic acid resin and anodically oxidizing an etching solution having an increased concentration of a halogenate.

JP 2006225693 describes a method of electrolytically oxidizing an aqueous solution containing iodine and/or iodic acid by an electrolytic process to produce periodates, more specifically, in the electrolytic process, an insoluble iodate or the like insoluble on the anode surface.

Clancy, M., C. J. Bettles, A. Stuart, et N. Birbilis. 2013. «The influence of alloying elements on the electrochemistry of lead anodes for electrowinning of metals: A review». *Hydrometallurgy* 131-132 (janvier): 144-57 describes the alloying elements used in lead alloy anodes and their effects on the electrochemistry and metallic properties of those alloys.

When starting from this prior art it was therefore the objective of the present invention to provide an electrolytic treatment device having an anode that is efficient for the re-oxidation process and shows low dissolution in the etching solution. Moreover, the process should be easy to handle and cost-effective. The process is applied at industrial level, lead anodes are heavy obviously for their density, so their maintenance (cleaning, substitution . . . ) must be limited in frequency.

This problem is solved by the specific lead alloy employed in the electrolytic treatment device with the features of claim 1 and the method for etching plastic parts with the features of claim 8. The further dependent claims describe preferred embodiments.

According to the present invention an electrolytic treatment device is provided which comprises

- an anodic compartment comprising a non-chromium (VI) etching solution as anolyte and immersed therein an anode,
- a cathodic compartment comprising a cathodic solution comprising an inorganic acid as catholyte and immersed therein a cathode, and
- a membrane separating the anodic from the cathodic compartment.

The anode, and optionally the cathode, of the device consist(s) of a ternary or higher Pb alloy (e.g. a quaternary Pb alloy) with Sn and at least one further metal selected from the group consisting of Sb, Ag, Co, Bi, and combinations thereof.

The electrochemical treatment device is characterized in that the non-chromium (VI) etching solution consists of 47-74 wt % of at least one inorganic acid,
0.01-5 wt % of at least one periodate salt,
0.01-0.5 wt % of at least one manganese salt,
0.01-5 wt % of at least one iodate salt, and
water up to 100%.

According to the invention, the term "manganese salt" is understood to encompass a permanganate salt. Preferably, the "manganese salt" is a permanganate salt.

It was surprisingly found that the use of a ternary or higher lead alloy with Pb, Sn and at least one further metal, allows the generation of a stable $PbO_2$ catalytic layer on the surface of the anode in an acidic etching environment with a better performance compared to known binary lead alloys. The performance of the $PbO_2$ catalytic layer (formed on the anodic surface) is monitored by the capacity to oxidize the iodate in function of both the energy given to the reoxidation module and the time. This is defined as the re-oxidation module rate, measured in g of iodate reoxidized by Ah applied. The stability of the ternary or higher alloy is also evaluated by measurement of its dissolution (the weight loss of the anode) in function of the immersion time in the high oxidant and acidic medium.

In a specific embodiment, the third metal is Sb. In a specific embodiment, the third metal is Co. In a specific embodiment, the third metal is Ag. In a specific embodiment, the third metal is Bi. Moreover, in case of a quaternary alloy, a specific embodiment comprises the third metal is Sb and the fourth metal is Ag, Bi or Co.

In a preferred embodiment, the alloy comprises from 85 to 95% Pb, preferably from 87 to 93% Pb, more preferably from 89 to 92% Pb.

In a preferred embodiment, the alloy comprises from 0.5 to 10% Sn, preferably from 1 to 8% Sn, more preferably from 1.5 to 7% Sn.

In a further preferred embodiment, the alloy is a ternary alloy and comprises from 0.05 to 10% of the third metal, preferably from 0.5 to 8% of the third metal, more preferably from 1 to 7% of the third metal.

A further preferred embodiment of the inventive etching solution comprises 47-74 wt % of at least one inorganic acid, 1-4 wt %, preferably 2.2-3.8 wt %, of at least one metaperiodate salt, preferably of sodium metaperiodate, 0.01-0.1 wt %, preferably 0.01-0.06 wt %, of at least one manganese salt, 0.01-2 wt %, preferably 0.01-0.64 wt %, of at least one iodate salt, preferably of sodium iodate and water up to 100%.

In a preferred embodiment, the inorganic acid of the anolyte and/or the catholyte is phosphoric acid or sulfuric acid, preferably phosphoric acid.

Moreover, according to the present invention, a method for etching plastic is provided with the following steps:

a) providing the electrolytic treatment device of any of the claims 1 to 6, b) immersing a plastic part in the etching solution as anolyte in the anodic compartment chamber, and c) applying a current from 1 to 8 A/dm$^2$ for re-oxidising the iodate to periodate in the anodic compartment.

It is preferred that during step c) the iodate in the etching solution is reoxidised to periodate.

In a preferred embodiment, the cathodic solution comprises a phosphoric acid. The anolyte (i.e. the etching solution) preferably comprises 54-74 wt % (weight percentage) phosphoric acid, 0-0.64 wt % Na iodate, 2-4 wt % Na metaperiodate, 0.01-0.06 wt % manganese salts, and water up to 100 wt %.

In a preferred embodiment, the temperature during the etching step is comprised from 50 to 80° C., more preferably from 60 to 70° C.

In a preferred embodiment, the re-oxidation rate of the module to re-oxidize the iodate to metaperiodate following this method is from 0.1 to 1 g/Ah, preferably from 0.2 to 0.8 g/Ah, more preferably from 0.3 to 0.6 g/Ah.

The re-oxidation rate refers to iodate oxidation and is measured at a specific flow of anolyte circulation between the etching tank and the anodic module compartment. It is measured from the concentration of iodate and periodate present in the etching bath before applying the current and the second measurement after different Ah applied to the module. Those concentrations can be measured by titration or by high-performance liquid chromatography (HPLC).

It represents the capacity to re-oxidize the iodate according the given energy to the electrolytic cell. A part of this energy serves to oxidize the iodate and the other to produce oxygen. The ideal solution would be that all of the energy was used to oxidize the iodate, but depending on the anode performance, more or less oxygen will be developed at the anode surface.

The dissolution of the anode immersed in the etching solution without any current applied is preferably from 0.1 to 3 g/dm$^2$ day, more preferably from 0.1 to 2 g/dm$^2$ day, and even more preferably from 0.1 to 1 g/dm$^2$ day.

It is preferred that the dissolution of the anode immersed in the etching solution (applied current from 0.8 to 1 A/dm2) is from 0.05 to 0.8 g/dm$^2$ day, more preferably from 0.05 to 0.7 g/dm$^2$ day, and even more preferably from 0.05 to 0.6 g/dm$^2$ day.

The dissolution of the anode is measured by the weight loss of the anode over the immersion time in the etching solution.

BRIEF DESCRIPTION OF THE DRAWINGS

With reference to the following figures and examples, the subject-matter according to the present invention is intended to be explained in more detail without wishing to restrict said subject-matter to the specific embodiments shown here.

A) Pb91 Sb2 Sn7 anode as raw material, before use

Figure 2:
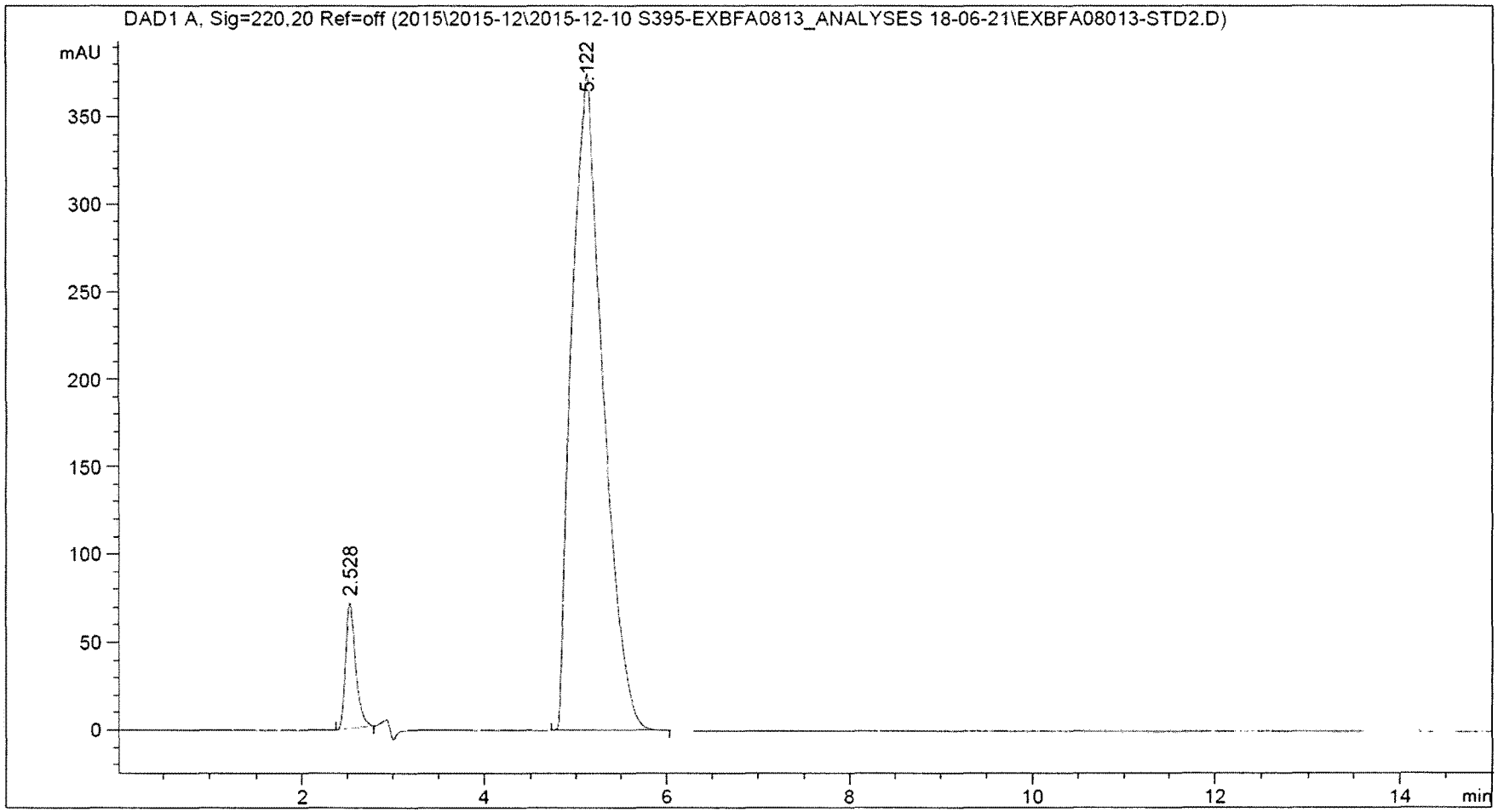

B) Pb91 Sb2 Sn7 anode after immersion in etching anolyte applying 3 A/dm$^2$ for 10 hours during workday and 0 A/dm$^2$ for 14 hours during pause at night C) Pb91 Sb2 Sn7 anode after immersion in etching anolyte applying 3 A/dm$^2$ for 10 hours during workday and 1 A/dm$^2$ for 14 hours during pause at night D) Pb90 Sn10 anode after immersion with 3 A/dm$^2$ during workday and 0 A/dm$^2$ during pause at night FIG. 2 shows a HPLC chromatogram used for the measurement of the concentration of iodate and periodate. The retention peak for iodate can be observed on the chromatogram at 2.5 minutes and the retention peak for periodate at 5.1 minutes.

EXAMPLES

Preparation of the Etching Bath

The etching bath is prepared with the compounds found in the following table 1.

TABLE 1

| Compounds | Concentration | Concentration range |
|---|---|---|
| $KMnO_4$ | 0.03 wt % | 0.01-0.06 wt % |
| $NaIO_4$ | 3.20 wt % | 2.2-3.8 wt % |
| Phosphoric acid 85% | 67 wt % | 54.0-74.0 wt % |
| $NaIO_3$ | 0.6 wt % | 0-0.64 wt % |
| H2O | Up to 100 wt % | Up to 100 wt % |

The bath temperature should be maintained around 60 to 70° C.

Use of the Anode

Figure 1:
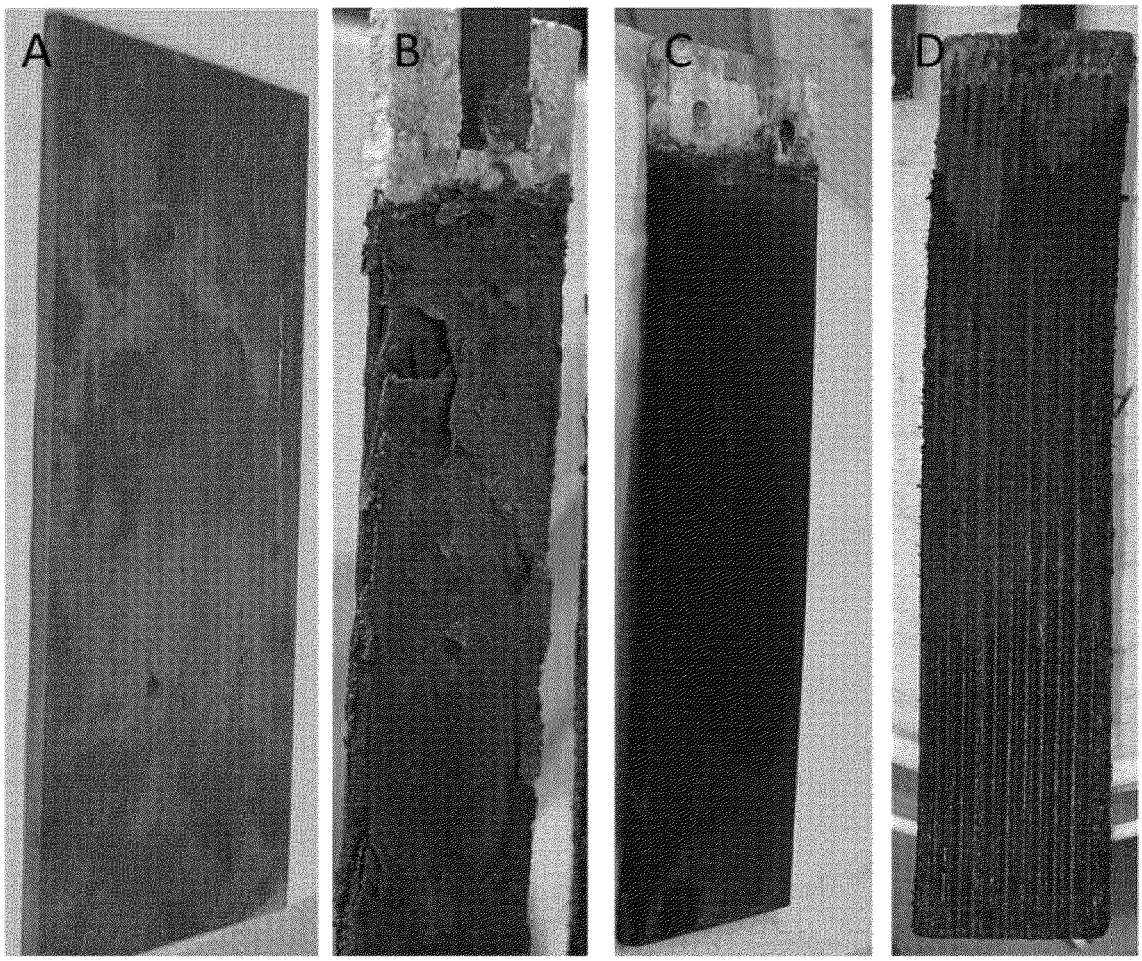
FIG. 1 shows different anodes after different exposition into re-oxidation conditions and with different operating conditions.

The anodes and cathodes are immersed respectively in the anodic and cathodic compartment and connected to the rectifier. The electrolytic treatment device is powered on at 3 A/dm$^2$ and the anolyte is circulating from the etching tank to the anodic compartment at 4 L/min flow. Different compositions of anodes were used during those tests and they are listed in table 2 below. Some of the anodes are presented on FIG. 1.

TABLE 2

| Anode composition | Reoxidation rate | Dissolution | Anode surface cleaning |
|---|---|---|---|
| Pb (99.9) | Continuous 0.2 g/Ah over Ah applied | 0.9 g/dm$^2$ day High dissolution rate Thin black powder and problem of bath filtration | Not necessary |
| Pb/Sn (90/10) | From 0.6 to 0 g/Ah in 60 Ah | 0.04 g/dm$^2$ day | Cleaning every 60 Ah |
| Pb/Ca/Sn (98.5/0.05/1.4) | From 0.6 to 0 g/Ah in 6 h | 0.04 g/dm$^2$ day | Cleaning every 60 Ah |
| Pb/Sb (95/5) | Continuous 0.5 g/Ah over Ah applied | 0.88 g/dm$^2$ day High dissolution | Not necessary |
| Pb/Sn/Sb (91/7/2) | Continuous 0.5 g/Ah over Ah applied | 0.22 g/dm$^2$ day | Not necessary |
| Pb/Sn/Ag (91/7/2) | From 0.5 to 0 g/Ah in 3000 Ah | 0.20 g/dm$^2$ day | Cleaning every 3000 Ah |

The anode dissolution is measured by the weight loss of the anode over the course of the experiment.

The re-oxidation rate has been measured by HPLC using a Symmetry C18 4.6×250 mm 5 μm (Waters) column and a detection at 220 nm. The result of such measurement are presented on FIG. 2.

The results of our test show that we have obtained the best result with the Pb/Sn/Sb anode. They have a good re-oxidation rate with a low dissolution and the lowest maintenance of all the tested anodes.

The invention claimed is:

1. An electrolytic treatment device having an anodic compartment comprising a chromium (VI) free etching solution as anolyte and immersed therein an anode, a cathodic compartment comprising a cathodic solution comprising an inorganic acid as catholyte and immersed therein a cathode, a membrane separating the anodic from the cathodic compartment;

wherein the anode, and optionally the cathode, consist(s) of a ternary or higher Pb alloy with Sn and at least one further metal selected from the group consisting of Sb, Ag, Co, Bi, and combinations thereof, wherein the chromium (VI) free etching solution consists of:

47-74 wt % of at least one inorganic acid, 0.01-5 wt % of at least one periodate salt, 0.01-0.5 wt % of at least one manganese salt, 0.01-5 wt % of at least one iodate salt, and water up to 100%.

2. The device according to claim 1, wherein the at least one further metal is Sb, Bi or Ag.

3. The device according to claim 1, wherein the alloy comprises from 85 to 95 wt. % of Pb.

4. The device according to claim 1, wherein the alloy comprises from 0.5 to 10 wt. % of Sn.

5. The device according to claim 1, wherein the alloy comprises from 0.05 to 10 wt. % of the third metal.

6. The device according to claim 1, wherein the etching solution consists of:

47-74 wt % of at least one inorganic acid, 1-4 wt % of at least one periodate salt, 0.01-0.1 wt % of at least one manganese salt, 0.01-2 wt % of at least one iodate salt, and water up to 100%.

7. The device according to claim 6, wherein the inorganic acid of the anolyte and/or the catholyte is phosphoric acid or sulfuric acid.

8. The device according to claim 6, wherein the etching solution consists of:

47-74 wt % of at least one inorganic acid, 2.2-3.8 wt %, of at least one periodate salt, 0.01-0.06 wt %, of at least one manganese salt, 0.01-0.64 wt %, of at least one iodate salt, and water up to 100%.

9. The device according to claim 6, wherein the periodate salt comprises sodium metaperiodate.

10. The device according to claim 6, wherein the iodate salt comprises sodium iodate.

11. Method for etching plastic parts with the following steps:

a) providing the electrolytic treatment device of claim 1, b) immersing a plastic part in the etching solution as anolyte in the anodic compartment chamber, and c) applying a current from 1 to 8 A/dm$^2$ for re-oxidizing the iodate to periodate in the anodic compartment.

12. The method of claim 11, wherein the temperature during step c) is from 50 to 80° C.

13. The method according to claim 11, wherein the re-oxidation rate to reoxidize the iodate to periodate is from 0.1 to 1 g/Ah.

14. The method according to claim 11, wherein the dissolution of the anode immersed in the etching solution without any current applied is from 0.1 to 3 g/dm$^2$ day.

15. The method according to claim 11, wherein the dissolution of the anode immersed in the etching solution with a current from 0.8 to 1 A/dm$^2$ current applied continuously is from 0.05 to 0.8 g/dm$^2$ day.

* * * * *